US010008375B2

(12) United States Patent
Ouyang et al.

(10) Patent No.: US 10,008,375 B2
(45) Date of Patent: Jun. 26, 2018

(54) SYSTEMS AND METHODS FOR ANALYZING AN EXTRACTED SAMPLE

(71) Applicant: Purdue Research Foundation, West Lafayette, IN (US)

(72) Inventors: Zheng Ouyang, West Lafayette, IN (US); Yue Ren, West Lafayette, IN (US); Jiangjiang Liu, West Lafayette, IN (US); Linfan Li, West Lafayette, IN (US)

(73) Assignee: Purdue Research Foundation, West Lafayette, IN (US)

( * ) Notice: Subject to any disclaimer, the term of this patent is extended or adjusted under 35 U.S.C. 154(b) by 0 days. days.

(21) Appl. No.: 14/426,591

(22) PCT Filed: Jan. 10, 2014

(86) PCT No.: PCT/US2014/011000

§ 371 (c)(1),
(2) Date: Mar. 6, 2015

(87) PCT Pub. No.: WO2014/120411

PCT Pub. Date: Aug. 7, 2014

(65) Prior Publication Data

US 2015/0325423 A1 Nov. 12, 2015

Related U.S. Application Data

(60) Provisional application No. 61/779,673, filed on Mar. 13, 2013, provisional application No. 61/759,247, filed on Jan. 31, 2013.

(51) Int. Cl.
*H01J 49/00* (2006.01)
*H01J 49/04* (2006.01)
(Continued)

(52) U.S. Cl.
CPC ..... *H01J 49/0409* (2013.01); *H01J 49/0431* (2013.01); *H01J 49/167* (2013.01); *H01J 49/4205* (2013.01)

(58) Field of Classification Search
CPC ..... H01J 49/00; H01J 49/020409; H01J 49/0431; H01J 49/0459; H01J 49/0463
(Continued)

(56) References Cited

U.S. PATENT DOCUMENTS 3,000,836 A 9/1961 Ginsburg
3,334,233 A 8/1967 Veal
(Continued)

FOREIGN PATENT DOCUMENTS

CN 101820979 A 9/2010
CN 102414778 A 4/2012
(Continued)

OTHER PUBLICATIONS

Joyce, Special Report: Glassware, Plasticware Compete in Labs, May 27, 1991, The Scientist Magazine.*
(Continued)

*Primary Examiner* — Jason McCormack
(74) *Attorney, Agent, or Firm* — Brown Rudnick LLP; Adam M. Schoen

(57) ABSTRACT

The invention generally relates to systems for analyzing a sample and methods of use thereof. In certain aspects, the invention provides systems that include an ionization probe and a mass analyzer. The probe includes a hollow body that has a distal tip. The probe also includes a substrate that is at least partially disposed within the body and positioned prior to the distal tip so that sample extracted from the substrate flows into the body prior to exiting the distal tip. The probe also includes an electrode that operably interacts with sample extracted from the substrate.

16 Claims, 12 Drawing Sheets

(51) Int. Cl.
*H01J 49/16* (2006.01)
*H01J 49/42* (2006.01)

(58) Field of Classification Search
USPC ..... 250/281, 282, 283, 284, 288
See application file for complete search history.

(56) References Cited

U.S. PATENT DOCUMENTS 4,235,838 A 11/1980 Redmore et al.
4,755,670 A 7/1988 Syka et al.
4,757,198 A 7/1988 Korte et al.
4,828,547 A 5/1989 Sahi et al.
4,885,076 A 12/1989 Smith et al.
4,957,640 A 9/1990 Treybig et al.
5,141,868 A 8/1992 Shanks et al.
5,152,177 A 10/1992 Buck et al.
5,288,646 A 2/1994 Lundsgaard et al.
5,583,281 A 12/1996 Yu
6,297,499 B1 10/2001 Fenn
6,452,168 B1 9/2002 McLuckey et al.
6,477,238 B1 11/2002 Schneider et al.
6,627,881 B1 9/2003 Bertrand et al.
6,645,399 B2 11/2003 Ahn et al.
6,982,416 B2 1/2006 Villinger et al.
6,992,284 B2 1/2006 Schultz et al.
7,005,635 B2 2/2006 Ahem et al.
7,010,096 B1 3/2006 Wooding
7,154,088 B1 12/2006 Blain et al.
7,171,193 B2 1/2007 Hoffman
7,223,969 B2 5/2007 Schultz et al.
7,259,019 B2 8/2007 Pawliszyn et al.
7,384,793 B2 6/2008 McCash et al.
7,384,794 B2 6/2008 Pawliszyn
7,510,880 B2 3/2009 Gross et al.
7,544,933 B2 6/2009 Cooks et al.
7,564,027 B2 7/2009 Finch et al.
7,714,281 B2 5/2010 Musselman
7,915,579 B2 3/2011 Chen et al.
7,930,924 B2 4/2011 Krogh et al.
8,030,088 B2 10/2011 McCash et al.
8,076,639 B2 12/2011 Cooks et al.
8,294,892 B2 10/2012 Sardashti et al.
8,304,718 B2 11/2012 Ouyang et al.
8,330,119 B2 12/2012 Chen et al.
8,334,505 B2 12/2012 Robinson et al.
8,421,005 B2 4/2013 Musselman
8,481,922 B2 7/2013 Musselman
8,704,167 B2 4/2014 Cooks et al.
8,710,437 B2 4/2014 Cooks et al.
8,754,365 B2 6/2014 Krechmer et al.
8,816,275 B2 8/2014 Ouyang et al.
8,859,956 B2 10/2014 Ouyang et al.
8,859,958 B2 10/2014 Ouyang et al.
8,859,959 B2 10/2014 Ouyang et al.
8,859,986 B2 10/2014 Cooks et al.
8,895,918 B2 11/2014 Cooks et al.
8,932,875 B2 1/2015 Cooks et al.
9,165,752 B2 10/2015 Cooks et al.
2002/0034827 A1 3/2002 Singh et al.
2002/0055184 A1 5/2002 Naylor et al.
2002/0123153 A1* 9/2002 Moon ..... G01N 30/6095 436/173
2003/0136918 A1 7/2003 Hartley
2003/0141392 A1 7/2003 Nilsson et al.
2003/0180824 A1 9/2003 Mpock et al.
2003/0199102 A1 10/2003 Ostrup
2004/0011954 A1 1/2004 Park
2004/0075050 A1 4/2004 Rossier et al.
2004/0245457 A1 12/2004 Granger et al.
2005/0072917 A1 4/2005 Becker
2005/0112635 A1 5/2005 Gentle et al.
2005/0117864 A1 6/2005 Dziekan et al.
2005/0247870 A9 11/2005 Park
2006/0093528 A1 5/2006 Banerjee et al.
2006/0118713 A1 6/2006 Matsui et al.
2006/0192107 A1 8/2006 DeVoe et al.
2006/0200316 A1 9/2006 Kanani et al.
2006/0249668 A1 11/2006 Goldberg et al.
2007/0003965 A1 1/2007 Ramsay et al.
2007/0025881 A1 2/2007 Thompson et al.
2007/0151232 A1 7/2007 Dalla Betta et al.
2007/0187589 A1 8/2007 Cooks et al.
2008/0083873 A1* 4/2008 Giardina ..... H01J 49/165 250/283
2008/0128608 A1 6/2008 Northen et al.
2008/0179511 A1 7/2008 Chen et al.
2008/0210856 A1 9/2008 Eide et al.
2008/0272294 A1 11/2008 Kovtoun
2008/0283742 A1* 11/2008 Takeuchi ..... H01J 49/066 250/288
2009/0071834 A1 3/2009 Hafeman et al.
2009/0090856 A1 4/2009 Grant et al.
2009/0127454 A1* 5/2009 Ritchie ..... C07F 9/091 250/282
2009/0152371 A1 6/2009 Stark et al.
2009/0280300 A1 11/2009 Craighead et al.
2009/0306230 A1 12/2009 Semikhodskii et al.
2009/0309020 A1 12/2009 Cooks et al.
2010/0001181 A1 1/2010 Moini
2010/0019143 A1 1/2010 Dobson et al.
2010/0059689 A1 3/2010 Horiike et al.
2010/0108879 A1 5/2010 Bateman et al.
2010/0230587 A1 9/2010 Marshall et al.
2010/0301209 A1 12/2010 Ouyang et al.
2011/0108724 A1 5/2011 Ewing et al.
2011/0108726 A1 5/2011 Hiraoka et al.
2011/0133077 A1* 6/2011 Henion ..... G01N 1/405 250/288
2011/0193027 A1 8/2011 Mackenzie et al.
2011/0210265 A1 9/2011 Lozano et al.
2012/0018629 A1 1/2012 Eikel et al.
2012/0112061 A1* 5/2012 Morokuma ..... H01J 49/0031 250/288
2012/0119079 A1* 5/2012 Ouyang ..... H01J 49/0431 250/282
2012/0153139 A1 6/2012 Qian et al.
2013/0023005 A1 1/2013 Chen et al.
2013/0112017 A1 5/2013 Ouyang et al.
2013/0112866 A1 5/2013 Ouyang et al.
2013/0112867 A1 5/2013 Ouyang et al.
2013/0273560 A1 10/2013 Cooks et al.
2013/0299694 A1 11/2013 Sato et al.
2014/0008532 A1 1/2014 Ouyang et al.
2014/0048697 A1 2/2014 Cooks et al.
2014/0165701 A1 6/2014 Wu et al.
2014/0183351 A1 7/2014 Cooks et al.

FOREIGN PATENT DOCUMENTS

JP 2011007690 A 1/2011
WO 200153819 A1 7/2001
WO 03104814 A2 12/2003
WO 2004/060278 A2 7/2004
WO 08/65245 A1 6/2008
WO 2009/023361 A2 2/2009
WO 2010/127059 A1 11/2010
WO 2012094227 A2 7/2012
WO 2012170301 A1 12/2012

OTHER PUBLICATIONS

Abe, et al. "Inkjet-Printed Microfluidic Multianalyte Chemical Sensing Paper," Anal. Chem. 2008, 80, pp. 6928-6934.
Atlas, et al., "Oil biodegradation and bioremediation: a tale of the two worst spilss in U.S. history" Environmental Science & Technology, 2011,45,6709-6715.
Bruzewicz et al. "Low-Cost Printing of Poly(dimethylsiloxane) Barriers to Define Microschannels in Paper," Anal. Chem. 2008, 80, pp. 3387-3392.
Cody et al., 2005, Versatile New Ion Source for the Analysis of Materials in Open Air under Ambient Condition, Anal. Chem. 77:2297-2302.

(56) References Cited

OTHER PUBLICATIONS

Cooks et al., (2011), New ionization methods and miniature mass spectrometers for biomedicine: DESI imaging for cancer diagnostics and paper spray ionization for therapeutic drug monitoring, Faraday Discussions 149:247-267, published in United Kingdom.
Cooks et al., 2006, Ambient Mass Spectrometry, Science 311:1566-1570.
Ferguson et al., Direct Ionization of Large Proteins and Protein Complexes by Desorption Electrospray Ionization-Mass Spectrometry, Anal. Chem. 2011, 83, 6468-6473.
Gao et al., "Design anc Characterization of a Multisource Hand-Held Tandem Mass Spectrometer", Z. Anal. Chem. 2008, 80, pp. 7198-7205.
Gao, et al. "Handheld Rectilinear Ion Trap Mass Spectrometer" Anal. Chem. 2006, 78, pp. 5994-6002.
Gao, L.; Sugiarto, A.; Harper, J. D.; Cooks, R. G.; Ouyang, Z. Anal. Chem., 2008, 80, 7198-7205.
Gaskell, 1997, Electrospray: Principles and Practice, J. Mass. Spect., 32:677-688.
Harris et al., 2011, Ambient Sampling/Ionization Mass Spectrometry: Applications and Current Trends Anal. Chem., 83:4508-4538.
Hou et al., "Sampling Wand for an Ion Trap Mass Spectrometer" Anal. Chem, 2011, 83, pp. 1857-1861.
Huang et al., 2010, Ambient Ionization Mass Spectrometry, Ann. Rev. Anal. Chem., 3:43-65.
Ifa et al., Desorption electrospray ionization and other ambient ionization methods: current progress and preview, Analyst 135, 669-681 (2010), published in United Kingdom.
International Preliminary Report of Patentability for PCT/US2010/032881 from International Bureau, dated Nov. 10, 2011, (10 pages).
International Preliminary Report on Patentability for PCT/US2009/045649 dated Dec. 9, 2010, (7 pages).
International Search Report and Written Opinion for PCT/US2010/032881 for International Searching Authority, dated Aug. 4, 2010, (10 pages).
International Search Report and Written Opinion dated Aug. 27, 2014, for International Patent Application No. PCT/US14/34767, filed Apr. 21, 2014, (20 pages).
International Search Report issued in PCT/US2014/011000 dated Apr. 19, 2014.
Kujawinski et al., "Fate of Dispersants Associated with the Deepwater Horizon Oil Spill" Science and Technology, 2011, 45, 1298-1306.
Li, et al. "Paper-Based Microfluidic Devices by Plasma Treatment," Anal. Chem. 2008, 80, pp. 9131-9134.
Liu et al., Recent advances of electrochemical mass spectrometry, Analyst, 2013, 138, 5519-5539.
Liu et al., Signal and charge enhancement for protein analysis by liquid chromatography-mass spectrometry with desorption electrospray ionization, International Journal of Mass Spectrometry 325-327 (2012) 161-166.
Lozano, et al. "Ionic Liquid Ion Sources: Characterization of Externally Wetted Emitters", Journal of Colloid and Interface Science 282 (2005) 415-421.
Lui et al., Measuring Protein?Ligand Interactions Using Liquid Sample Desorption Electrospray Ionization Mass Spectrometry, Anal. Chem. 2013, 85, 11966?11972.
Mandal, et al. "Solid probe assisted nanoelectrospray ionization mass spectrometry for biological tissue Diagnostics," Analyst, 2012, 137, pp. 4658-4661.
Martinez et al., "Flash: A rapid method for prototyping paper-based microfluidic devices," Lab Chip 2008, 8, pp. 2146-2150.
Martinez, et al. "Patterned Paper as a Platform for Inexpensive, Low-Volume, Portable Bioassays," Angew. Chem. Int. Ed. 2007, 46, pp. 1318-1320).
Martinez, et al. "Three-dimensional microfluidic devices fabricated in layered paper and tape," PNAS, 2008, 105, pp. 19606-19611.
Miao et.al., Direct Analysis of Liquid Samples by Desorption Electrospray Ionization-Mass Spectrometry (DESI-MS), J Am Soc Mass Spectrom 2009, 20, 10-19.
Nemes, P., Ambient mass spectrometry for in vivo local analysis and in situ molecular tissue imaging, TrAC—Trends in Analytical Chemistry 34, 22-33 (2012), published in United Kingdom.
Notification Concerning Transmittal of International Preliminary Report on Patentability for International Application No. PCT/US2014/034767 dated Jan. 7, 2016 (7 Pages).
Ratcliffe et al., 2007, Surface Analysis under Ambient Conditions Using Plasma-Assisted Desorption/Ionization Mass Spectrometry, Anal. Chem., 79:6094-6101.
Sokol et al., 2011, Miniature mass spectrometer equipped with electrospray and desorption electrospray ionization for direct analysis of organics from solids and solutions, Int. J. Mass Spectrum. 306:187-195.
Sokol, E.; Noll, R. J.; Cooks, R. G.; Beegle, L. W.; Kim, H. I.; Kanik, I.; Int. J. Mass Spectrom., 2011, In Press, Corrected Proof.
Soparawalla et al., Analyst, 2011, 136, 4392-4396.
Takats et al., Mass spectrometry sampling under ambient conditions with desorption electrospray ionization, Science 306, 471-473 (2004), published in USA.
Thibodeaux et al., "Marine Oil Fate: Knowledge Gaps, Basic Research, and Development Needs; a Perspective based on the Depwater Horizon Spill" Environmental Engineering Science, 2011, 28, 87-93.
Valentine, et al., "Propane respiration jump-starts microbial response to deep oiil spill", Science, 2010, 330(208-211).
Wang et al., Angewandte Chemie, 2010, 49, 877-880.
Zhang et al., Electrochemistry-Assisted Top-Down Characterization of Disulfide-Containing Proteins, Anal Chem. Apr. 17, 2012; 84(8): 1-7.
Zhang et al., Mass Spectrometric Analysis of Thiol Proteins/Peptides Following Selenamide Derivatization and Electrolytic Reduction of Disulfide Bonds, Dec. 2012, pp. 240.
Zhang et al., Paper Spray Ionization of Noncovalent Protein Complexes, Jan. 1, 2014, Anal. Chem. A-E.
Eckert et al., "Chemical Characterization of Crude Petroleum Using Nanospray Desorption Eelectrospray Ionization Coupled With High-Resolution Mass Spectrometry", Analytical Chemistry, 2011 (9 Pages).
Gough et al. "Analysis of Oilfield Chemicals by Electrospray Mass Spectrometry", Rapid Communications in Mass Spectrometry, 1999 (10 Pages).
Jjunji et al., "In Situ Analysis of Corrosion Inhibitors Using a Portable Mass Spectrometer with Paper Spray Ionization", Analyst, 138,3740, first published on-line May 9, 2013 (10 Pages).
Liu et al. "Development, Characterization and Application of Paper Spray Ionization", Anal. Chem. 2010 (9 Pages).
Oradu et al. "Multistep Mass Spectrometry Methodology for Direct Characterization of Polar Lipids in Green Microalgae Using Paperspray Ionization", Anal. Chem., 2012 (10 Pages).
International Search Report and Written Opinion of the International Searching Authority dated Jul. 8, 2014 for International Application No. PCT/US2014/012746 (27 Pages).
Gough et al., "Molecular Monitoring of Residual Corrosion Inhibitor Actives in Oilfields Fluids: Implications for Inhibitor Performance" Corrosion, 98 Paper No. 33 (1998) (12 Pages).
Extended European Search Report dated Sep. 7, 2016 for European Patent Application No. 14745610.7 (11 Pages).
Ren, Yue et al., "Direct Mass Spectrometry Analysis of Untreated Samples Ultralow Amounts Using Extraction Nano-Electrospray", Analytical Methods, vol. 5, No. 23, Sep. 20, 2013, pp. 6686-6692 (7 Pages).

* cited by examiner

| Concentration (ng/ml) | 0 | 7.5 | 15 | 60 | 120 | 210 | 510 |
|---|---|---|---|---|---|---|---|
| RSD | 16.98 | 10.13 | 9.53 | 6.47 | 8.63 | 4.78 | 7.11 |

SYSTEMS AND METHODS FOR ANALYZING AN EXTRACTED SAMPLE

RELATED APPLICATIONS

The present application is a 35 U.S.C. § 371 national phase application of PCT/US14/11000, filed Jan. 10, 2014, which claims the benefit of and priority to each of U.S. provisional patent application Ser. No. 61/779,673, filed Mar. 13, 2013, and U.S. provisional patent application Ser. No. 61/759,247, filed Jan. 31, 2013, the content of each of which is incorporated by reference herein in its entirety.

GOVERNMENT SUPPORT

This invention was made with government support under GM103454 awarded by the National Institutes of Health and CHE0847205 awarded by the National Science Foundation. The government has certain rights in the invention.

FIELD OF THE INVENTION

The invention generally relates to systems and methods for analyzing an extracted sample.

BACKGROUND

Chemical analysis using mass spectrometry traditionally involves sample extraction and chromatographic separation prior to mass analysis. For example, biofluids (e.g., complex mixtures such as blood, saliva, or urine) are routinely separated using chromatography before a mass spectrometry measurement in order to minimize suppression effects on analyte ionization and to pre-concentrate the analytes. Recently, systems and methods have been developed that allow for sample preparation and pre-treatment to be combined with the ionization process (See Ouyang et al., WO 2010/127059, the content of which is incorporated by reference herein in its entirety).

Those systems and methods use wetted porous material, named paper spray ionization, for direct, qualitative and quantitative analysis of complex biofluids. Analyte transport is achieved by wicking in a porous material with a macroscopically sharp point and a high electric field is used to perform ionization and chemical analysis of compounds present in biological samples. Pneumatic assistance is not required to transport the analyte; rather, a voltage is simply applied to the wet paper that is held in front of a mass spectrometer.

SUMMARY

The invention recognizes that a short coming of paper spray is that it generates short and unstable spray due to a fast drying of solvent on paper when operated with mass spectrometers using curtain gases. Additionally, paper spray has low sensitivity with miniature mass spectrometers due to relatively poorer desolvation. The invention solves those problems by providing a housing for the substrate that includes a spray tip.

The invention operates similar to paper spray in that sample is applied to a substrate. However, unlike paper spray, the sample is not directly ionized from the substrate. Rather, solvent is applied within the housing to interact with the substrate and extract sample analytes from the substrate. The sample analytes in the extraction solvent remain in an aqueous phase until application of a voltage to within the housing. At that time the analytes in the extraction solvent are expelled from the distal tip of the housing, thereby generating ions of the analytes. Probes of the invention are particularly suitable for use with nebulizing gas and have improved desolvation over paper spray.

In certain aspects, the invention provides systems that include an ionization probe and a mass analyzer. The probe includes a hollow body that has a distal tip. The probe also includes a substrate that is at least partially disposed within the body and positioned prior to the distal tip so that sample extracted from the substrate flows into the body prior to exiting the distal tip. In certain embodiments, the substrate is completely within the body. The probe also includes an electrode that operably interacts with sample extracted from the substrate. The electrode may be outside the body, fully disposed within the body, or only partially disposed within the body. The hollow body may be made of any material, and an exemplary material is glass. The hollow body may include a port for receiving a solvent. Alternatively, solvent is introduced to the substrate and enters the body by flowing through the substrate.

The substrate can be porous or non-porous material. In certain embodiments, the substrate is a porous material. Any porous material, such as polydimethylsiloxane (PDMS) membranes, filter paper, cellulose based products, cotton, gels, plant tissue (e.g., a leaf or a seed) etc., may be used as the substrate. The mass analyzer may be for a mass spectrometer or a miniature mass spectrometer. Exemplary mass analyzers include a quadrupole ion trap, a rectalinear ion trap, a cylindrical ion trap, an ion cyclotron resonance trap, or an orbitrap.

In certain embodiments, the system further includes a source of nebulizing gas. The source of nebulizing gas may be configured to provide pulses of gas. Alternatively, the source of nebulizing gas may be configured to provide a continuous flow of gas.

Another aspect of the invention provides methods for analyzing a sample. The methods involve introducing a solvent to a sample on a substrate that is at least partially disposed within a hollow body such that the solvent interacts with the substrate to extract to the sample from the substrate, applying a voltage to the extracted sample in the solvent so that the sample is expelled from a distal tip of the body, thereby generating ions of an analyte in the sample, and analyzing the ions. The substrate may be completely disposed within the body or only partially disposed within the body. In certain embodiments, a nebulizing gas is also applied to the extracted sample. The sample may be introduced to the substrate prior to the substrate being at least partially inserted into the hollow body. Alternatively, the sample may be introduced to the substrate after the substrate has been partially inserted into the hollow body.

BRIEF DESCRIPTION OF THE DRAWINGS

FIG. 2A: TSQ with a heated capillary API. FIG. 2B: Sciex QTRAP4000 with a curtain gas API. The ion chronograms by extraction spray (top lines) and paper sprays (bottom lines) were compared using both instruments. Mass spectrometers were set on single reaction monitoring (SRM) mode, and 10 μL of methanol was used as extraction solvent.

(FIG. 3A) nicotine in dried blood spots (DBSs), (FIG. 3B) methamphetamine in DBSs, (FIG. 3C) methamphetamine in urine, (FIG. 3D) clenbuterol in pork hommogenate, (FIG. 3E) atrazine in river water, and (FIG. 3F) thiabendazole in orange homogenate.

DETAILED DESCRIPTION

Figure 1A:
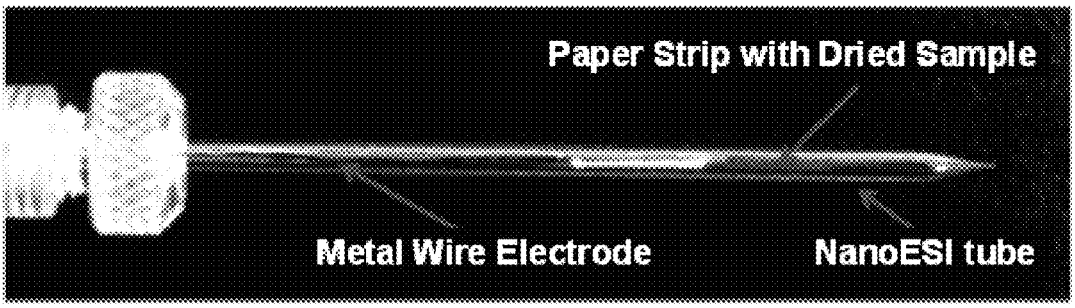
FIG. 1A is a photograph of an extraction spray ion source for MS analysis.
Figure 6:
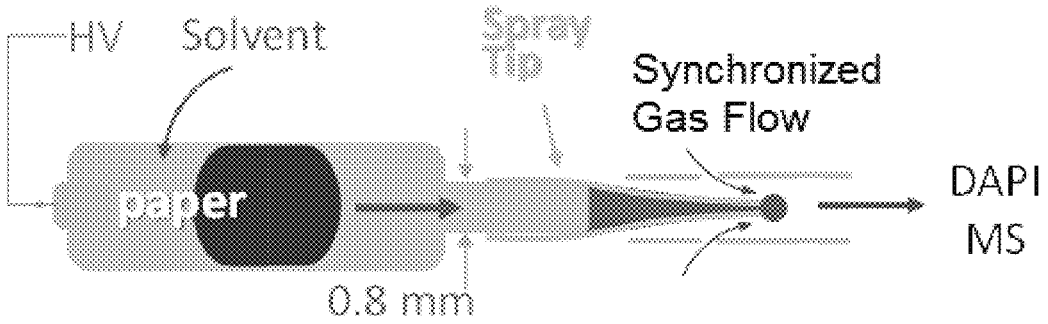
FIG. 6 is a schematic showing an extraction spray probe in which the substrate is only partially disposed within the body (spray tip). The DAPI is an optional component of the system and the substrate shape shown is an exemplary shape with exemplary dimensions.

The invention provides extraction spray ionization for direct analysis of raw samples with complex matrices. In certain embodiments, systems of the invention include an ionization probe. An exemplary probe is shown in FIG. 1A. The probe includes a hollow body that has a distal tip. An exemplary hollow body is one similar to that used for nanoESI. Exemplary nano spray tips and methods of preparing such tips are described for example in Wilm et al. (Anal. Chem. 2004, 76, 1165-1174), the content of which is incorporated by reference herein in its entirety. A substrate is at least partially disposed within the body and positioned prior to the distal tip so that sample extracted from the substrate flows into the body prior to exiting the distal tip. In certain embodiments, such as shown in FIG. 1A, the substrate is completely within the body. In other embodiments, such as shown in FIG. 6, the substrate is only partially disposed within the body (spray tip). The hollow body may include a port for receiving a solvent (FIG. 1A). Alternatively, solvent may be introduced to the substrate and enters the body by flowing through the substrate (FIG. 6). The probe also includes an electrode that operably interacts with sample extracted from the substrate. The electrode may be outside the body (FIG. 6), fully disposed within the body, or only partially disposed within the body (FIG. 1A). The probe is operably coupled to a mass spectrometer, such that ions produced by the probe enter the mass spectrometer. The invention combines a fast extraction with an ionization process, such as nanospray, which allows direct analysis of raw samples and a much improved spray ionization to provide a good sensitivity to ambient analysis using a wide variety of mass spectrometers.

Figure 1B:
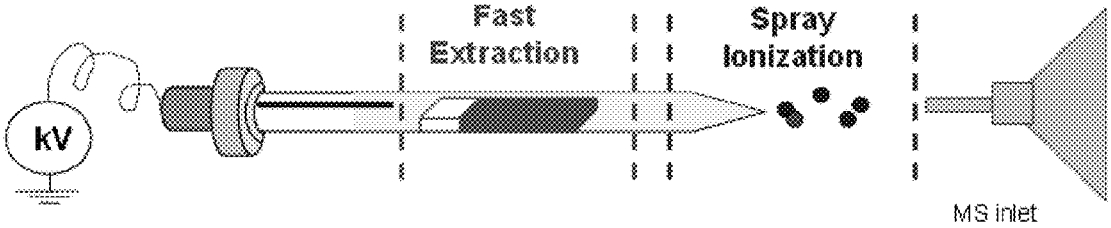
FIG. 1B is a schematic of the extraction spray ionization process, with two proposed steps: extraction and spray ionization.

Extraction spray includes a fast extraction of the analytes from sample on a substrate and a subsequent spray of the extraction solution using a spray tip. Based on the extraction-ionization model proposed, extraction spray can be viewed as a two-step process, as demonstrated in FIG. 1B. At the extraction step, extraction solvent rapidly extracts analyte matrices from a dried sample, such as dried blood spots or dried tissue homogenates, which were deposited on a sample substrate within a nanoESI tube. Similar to the paper spray process, the differences on extraction efficiencies of solvents to analytes as well as adsorbing powers of samples to substrates are expected to have significant impact on this step. Followed by the fast extraction, the extractants entrained in solvent are sprayed and ionized. In the exemplary embodiment shown in FIGS. 1A-B, that process is a nanoESI-like process. The charged droplets generated by extraction spray have a much smaller size as compared to droplets produced by paper spray. Without being limited by any particular theory or mechanism of action, it is believed that the smaller droplet size produced by systems of the invention is due to its similar droplet generation as nanoESI, and a more efficient gas phase charged droplet desolvation process which occurs prior to the spray droplets entrance into a mass analyzer. Thus, this simple approach has the potential to elevate the performance of miniature mass spectrometers in which desolvation strategies are seldom applied as a compromise to portability.

Figure 1C:
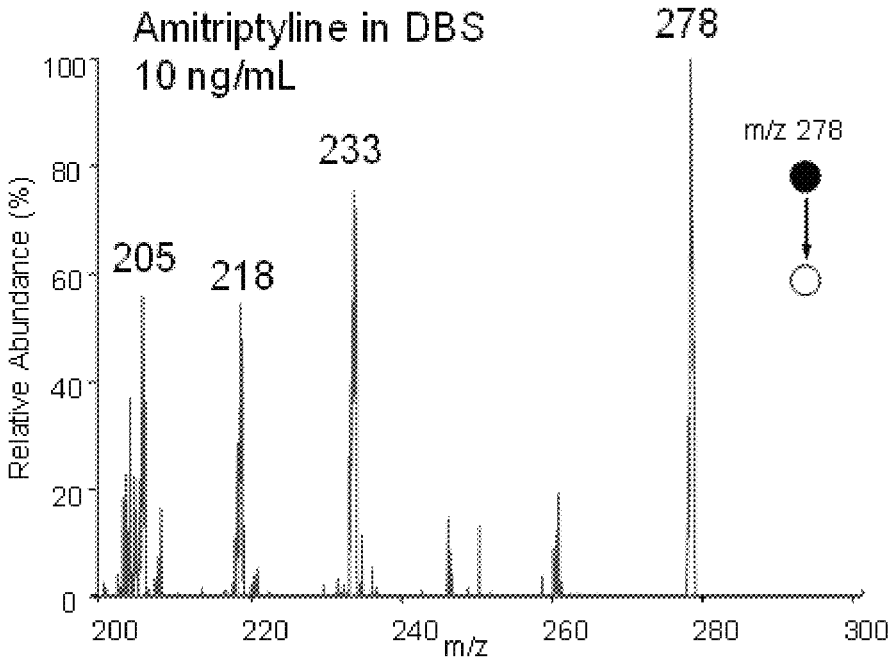
FIG. 1C is an extraction spray-MS/MS spectrum for dried blood analysis using 10 μL methanol as spray solvent, 0.2 μL blood containing 10 ng/mL amitriptyline.
Figure 1D:
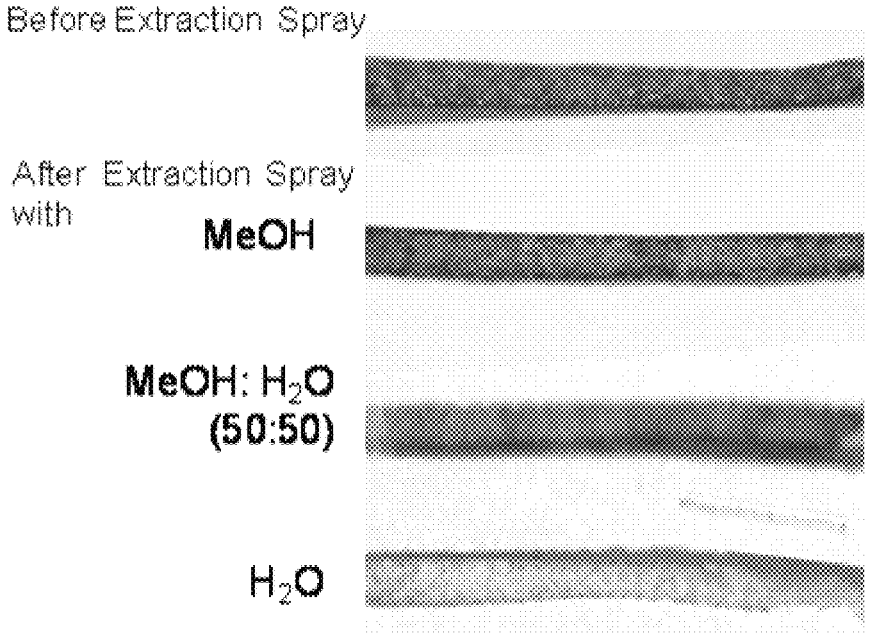
FIG. 1D is a set of photographs of loaded samples before and after extraction spray process with different solvents (pure methanol, methanol/water 50/50 and pure water).

Extraction spray has both good sensitivity, similar to that of nanoESI, and high matrix tolerance, similar to that of paper spray. FIG. 1C shows the extraction spray-MS result for the analysis of dried blood spots (DBSs) on paper substrates with 0.2 μL whole blood samples containing 10 ng/mL amitryptline. With only 0.2 μL sample, ultralow concentration of amitriptyline (10 ng/mL) was able to be detected from the DBS. 10 μL of Methanol and water mixed with different volume ratio were used as solvents for the test. Photographs of the sampling strips were taken before and after the DBS analysis using methanol/water (100/0, 50/50 and 0/100, v/v ratio) as extraction solvents (FIG. 1D). The increase of the aqueous component in the solvent system was found to extract more materials from the DBSs into the solvent phase, which was beneficial to the blood analysis using extraction spray-MS.

The signal stabilities and durations of extraction spray and paper spray were compared using mass spectrometers of different APIs: a heated capillary API (TSQ) and a curtain gas API (Sciex QTRAP4000). For extraction spray, 0.2 μL samples, 200 ng/mL sunitinib in blood, were preloaded and dried on paper strips before insertions into nanoESI tubes. Extraction solvent, 10 μL methanol, was consequently added through the end of the tubes, and constant sprays were formed with the assistance of a spray voltage of 2 kV. Paper spray operations similar to previous studies were used: the same amount of samples, 0.2 μL sunitinib in bovine blood, were spotted and dried on the centers of paper triangles, and elution solvent of 10 μL methanol was applied for generating a stable spray. About 3.5 k DC voltage was used to facilitate paper spray. The chronogram for product ion m/z 283 were recorded using single reaction monitoring mode (SRM) on both TSQ and QTRAP4000 mass spectrometers. With a heated capillary API, paper spray was able to generate an intensive chronogram with a bimodal pattern: product ion of good abundance was generated at the beginning followed by a decrease in signal intensity, and the abundance of product ion increased to an even higher level before the final signal decay as the expiration of elution solvent happened around 1.0 min (FIG. 2A, bottom signal).

Figure 2A:
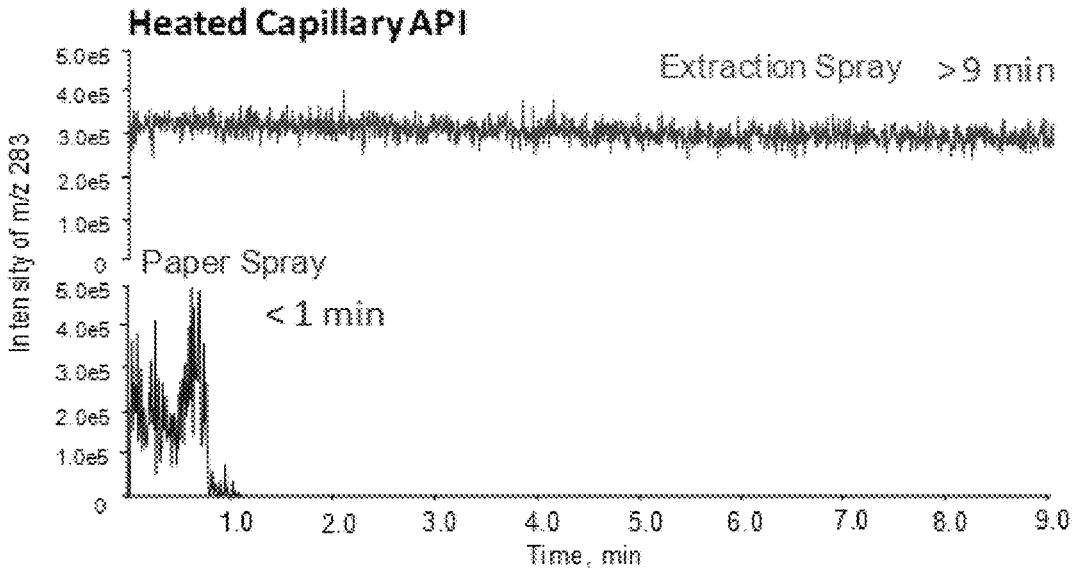
FIGS. 2A-B are ion chronograms for the product ion m/z 283 of sunitinib, prepared by 0.2 μL, 200 ng/mL sunitinib in blood samples, using mass spectrometers with different API.
Figure 2B:
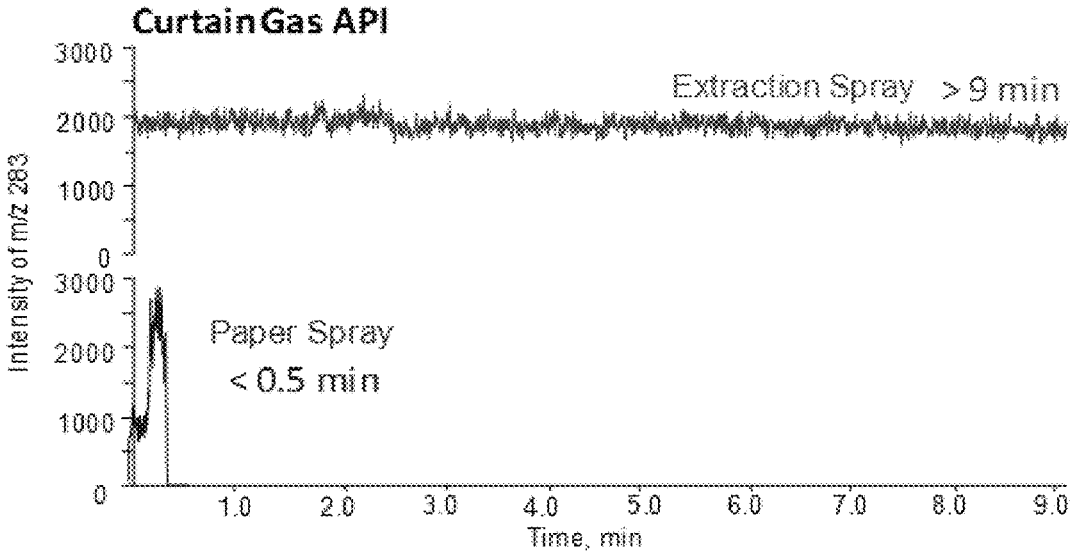

In contrast, extraction spray demonstrated a stable signal with a much longer signal duration (>9.0 min) but a little lower signal abundance (FIG. 2A, top signal). More significant differences of the ion chronograms between the two methods were observed when using a Sciex QTRAP4000 with a curtain gas API. Stable signals with long duration (>9 min) were generated by extraction spray (FIG. 2B, top signal) and a bimodal ion chronogram with good signal abundance of less than 20.0 sec was obtained in paper spray (FIG. 2B, bottom signal). In general, the signal of extraction spray was able to be maintained for longer than 30 min. The signal intensities of paper spray were slightly higher than extraction spray in both cases, but of significantly shorter duration. The spray current of both methods were measured respectively. Higher spray but dynamic spray current was generated during paper spray process (0.17-0.77 μA), while the spray current stayed constant, 0.28 μA, in extraction spray. Considering the absence of flow dynamics control in paper spray, the observations of dynamic signal produced in paper spray were believed to be caused by continuous reduction of the solvent amount on the paper substrate and the difference in the desolvation of charged droplets which were derived from Taylor cone jets. In other words, even highly charged droplets were formed during papers spray at reducing flow rates. Only a portion of the droplets having a smaller size were able to be completely desolvated within the APIs to form detectable ions. The reduction of signal duration in paper spray with the curtain gas API was owed to a faster solvent vaporization on the paper substrate facilitated by curtain gas flow. The signal duration in extraction spray was able to be maintained because of the protection of the solvent in the glass spray tube from the gas flow. Paper spray has demonstrated a strong quantitation capability using mass spectrometer of heated capillary API because the signal variations are able to be reduced by integrating signals over a longer acquisition time (typically >30 sec). However, limited by shorter signal duration, coupling paper spray-MS with a curtain gas API is a challenge. Systems and methods of the invention (i.e., extraction spray) solve that problem as illustrated by the data shown in FIGS. 2A-B.

Figure 2C:
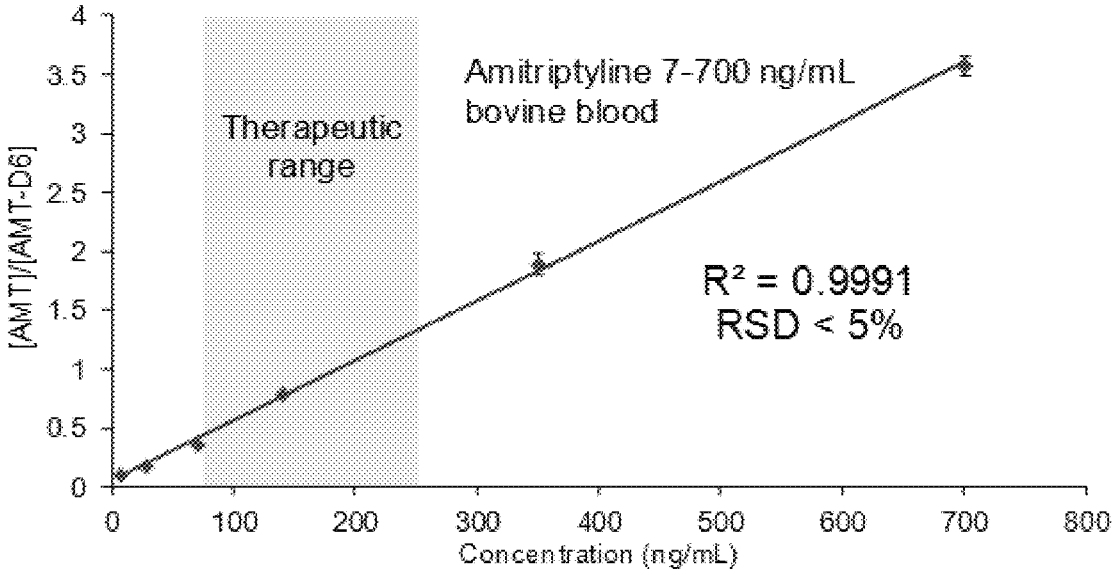
FIG. 2C is a calibration curve of amitriptyline, monitoring the intensity of the fragment ion m/z 233 using 10 μL methanol as solvent and 0.2 μL DBSs containing amitriptyline and [D6]amitriptyline as standard.

An assessment of the quantitation potential of extraction spray was conducted by using a therapeutic drug, amitriptyline m/z 277, prepared in whole bovine blood samples. The quantitation of amitriptyline was obtained by using the intensity ratios of a product ion m/z 233 of amitriptyline to the corresponding fragment ion produced from [D6]amitriptyline which was added to amitriptyline samples as internal standard (FIG. 2C). The relative response is across a linear range 7-700 ng/mL with $R^2$=0.9991 covering the therapeutic range of amitriptyline (80-250 ng/mL). The relative standard deviations are less than 5% at all data points. Similar or better performances could be expected for quantitation of other small molecules from raw samples. In certain embodiments, the housing can include a coating of an internal standard, which allows for ultrafast MS analysis of complex sample.

Figure 3A:
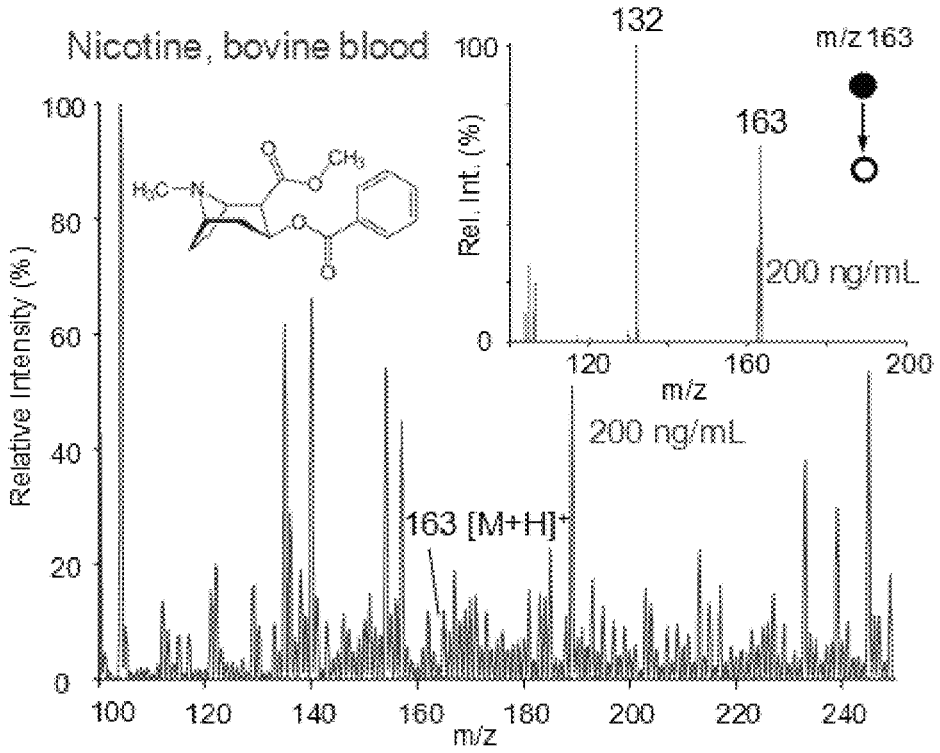
FIGS. 3A-F are mass spectra for chemicals in different matrices and corresponding tandem mass spectra using a Sciex QTRAP 4000. Spectra were obtained in the positive ion mode with a spray voltage 2 kV.
Figure 3B:
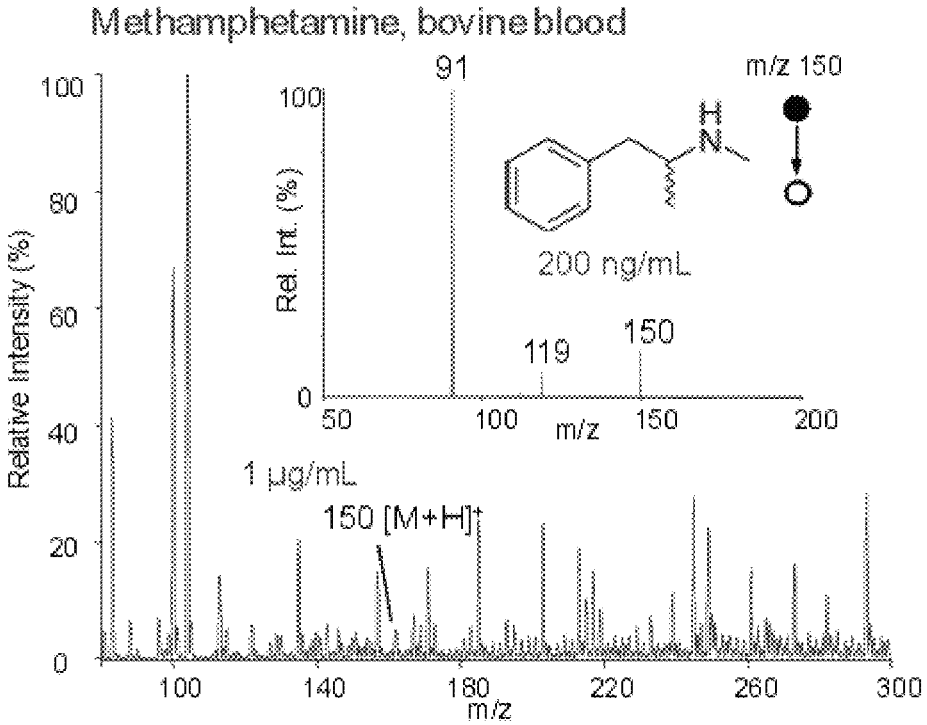
Figure 3C:
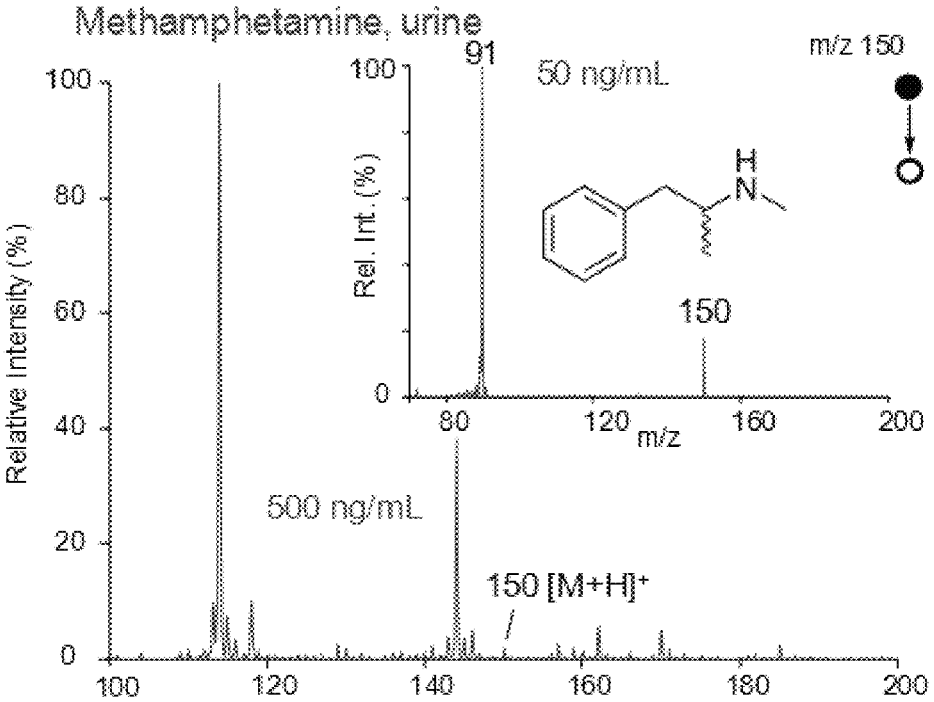
Figure 3D:
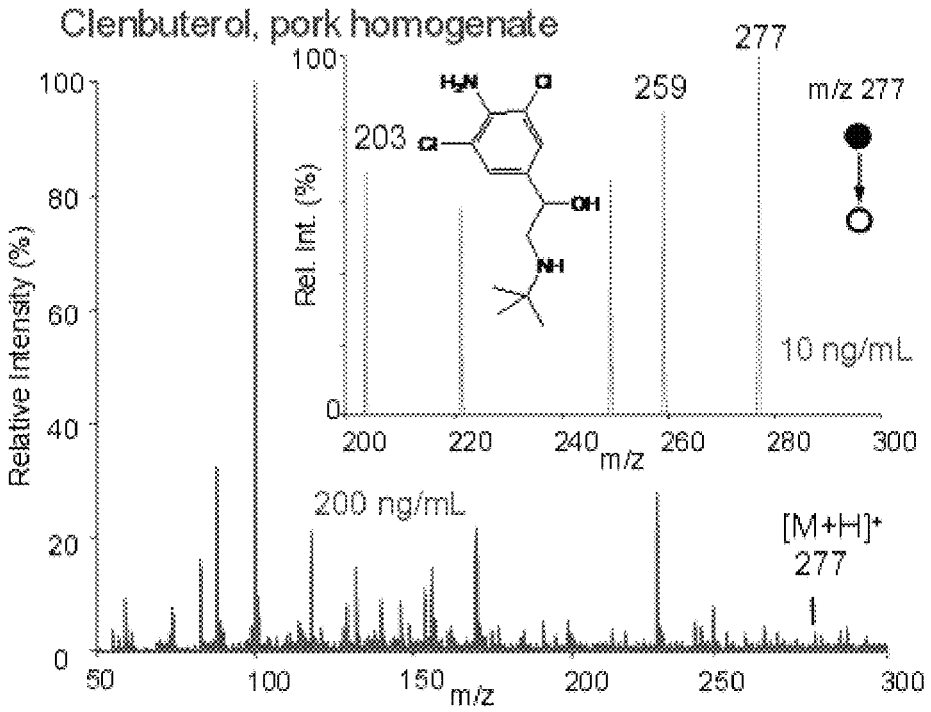
Figure 3E:
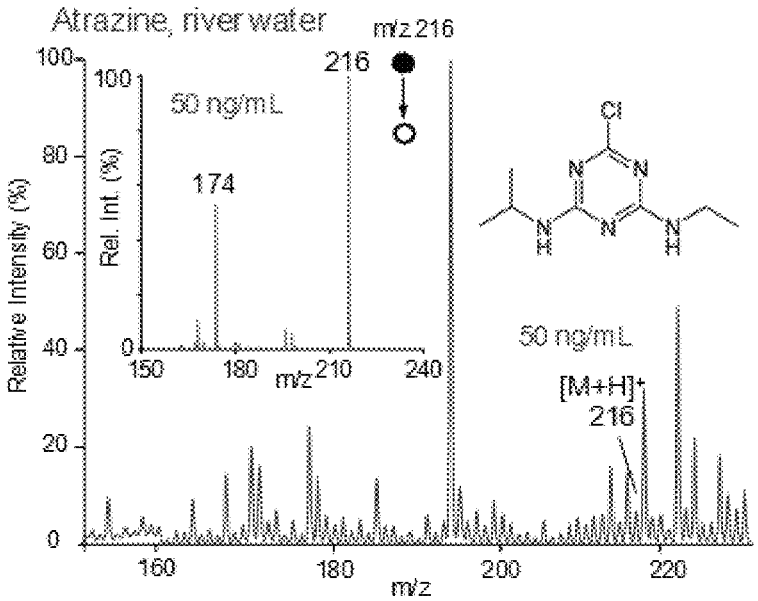
Figure 3F:
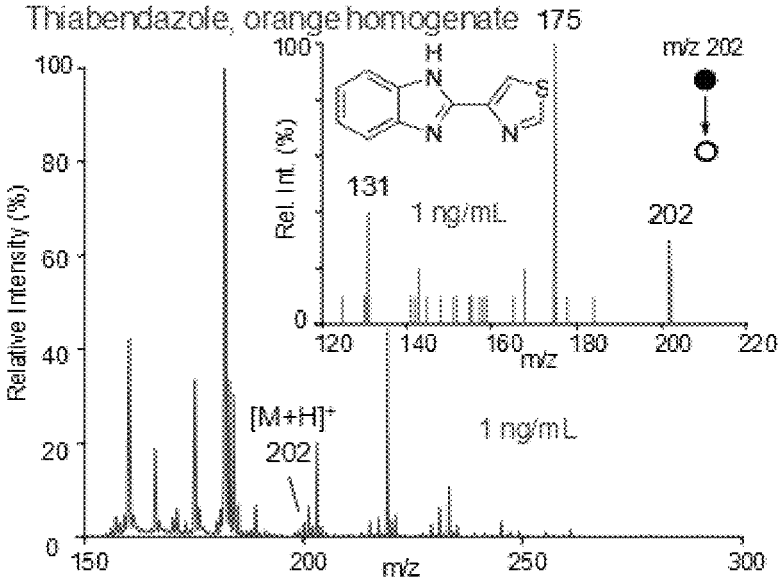

The versatility of extraction spray was characterized using a variety of chemicals which were prepared in complex matrices such as dried blood spots (DBSs) and tissue homogenates (FIGS. 3A-C). All the mass spectra and MS/MS spectra were acquired using extraction spray with 0.2 μL samples loaded on sample substrates and dried in air. The solvent condition was optimized by comparing the intensity of product ion m/z 91 of methamphetamine 200 ng/mL in DBSs, and 10 μL of methanol was determined as the extraction solvent based on the comparison. Similar to paper spray, all the chemicals demonstrated pseudo-molecular ion as the form $[M+H]^+$. In the analysis of psychoactive drugs, the mass spectra for nicotine in DBSs and methamphetamine in urine and DBSs were acquired (FIGS. 3A-C). Both MS and MS/MS spectra of methamphetamine in urine were observed with good S/N ratio. Although the drug peaks for methamphetamine and nicotine were overwhelmed by matrices in DBSs analysis, MS/MS spectrum with good S/N was able to be obtained at the concentration level of 200 ng/mL. In the analysis of food contaminations, 10 ng/mL clenbuterol in pork homogenate, product ions of good abundances could be observed in MS/MS spectra using 0.2 μL samples at concentration level of 10 ng/mL (FIG. 3D). For agriculture chemical screening, the ion signals of atrazine and thiabendazol of good S/N ratio in MS and MS/MS spectra were able to be observed at the ultralow concentration: 50 ng/mL and 1 ng/mL respectively (FIGS. 3E-F). The limits of detection (LODs) of chemicals in raw samples were determined (Table 1).

TABLE 1

Limits of detection (LODs) of chemicals in various matrices using extraction spray method.

| Chemicals | Category | Matrix | LOD (ng/mL) |
|---|---|---|---|
| Melamine | Contaminant | Milk | 1 |
| Clenbuterol | Contaminant | Pork homogenate | 0.5 |
| Atrazine | Herbicide | River water | 0.1 |
| Thiabendazole | Fungicide | Orange homogenate | 0.1 |
| Methamphetamine | Psychoactive drug | Blood | 0.1 |
| Nicotine | Psychoactive drug | Blood | 1 |
| Imatinib | Therapeutic drug | Blood | 1 |
| Verapamil | Therapeutic drug | Blood | 0.5 |
| Sunitinib | Therapeutic drug | Blood | 1 |

Good sensitivity and high matrix tolerance could be achieved by combining the extraction and the spray ionization. As discussed above, the new ion source can be used for analysis of a wide variety of chemical species, including psychoactive/therapeutic drugs, food contaminations and agricultural chemicals.

Sensitive and reliable result were achieved using ambient mass spectrometry with a combination of fast extraction and spray ionization (i.e., extraction spray). Durable and stable signals were produced by extraction spray when coupled with mass spectrometers of curtain gas API and heated capillary API. Linear response of 7-700 ng/mL was achieved in the quantitation of amitriptyline in whole blood samples. The detections of a variety of low concentration chemicals in different matrices demonstrates broad applications of this hybrid method.

Probes of the invention can be coupled to any type of mass analyzers and atmospheric pressure interfaces known in the art. Exemplary mass analyzers are a quadrupole ion trap, a rectalinear ion trap, a cylindrical ion trap, an ion cyclotron resonance trap, or an orbitrap. Probes of the invention can be coupled to interfaces and mass analyzers that utilize curtain gas. Such an exemplary system is an API (Sciex QTRAP4000). Alternatively, probes of the invention can be coupled to interfaces and mass analyzers that do not utilize curtain gas.

The mass analyzer may be for a bench-top or lab-scale mass spectrometer or a miniature mass spectrometer. An exemplary miniature mass spectrometer is described, for example in Gao et al. (Z. Anal. Chem. 2008, 80, 7198-7205), the content of which is incorporated by reference herein in its entirety. In comparison with the pumping system used for lab-scale instruments with thousands watts of power, miniature mass spectrometers generally have smaller pumping systems, such as a 18 W pumping system with only a 5 L/min (0.3 m3/hr) diaphragm pump and a 11 L/s turbo pump for the system described in Gao et al. Other exemplary miniature mass spectrometers are described for example in Gao et al. (Anal. Chem., 2006, 80:7198-7205, 2008), Hou et al. (Anal. Chem., 83:1857-1861, 2011), and Sokol et al. (Int. J. Mass Spectrom., 2011, 306, 187-195), the content of each of which is incorporated herein by reference in its entirety.

Substrates and Solvents

Exemplary substrates are described, for example in Ouyang et al. (U.S. patent application number 2012/0119079) and Ouyang et al. (U.S. patent application Ser. No. 14/119,548), the content of each of which is incorporated by reference herein in its entirety. In certain embodiments, the porous material is any cellulose-based material. In other embodiments, the porous material is a non-metallic porous material, such as cotton, linen, wool, synthetic textiles, or glass microfiber filter paper made from glass microfiber. In certain embodiments, the substrate is plant tissue, such as a leaf, skin or bark of a plant, fruit or vegetable, pulp of a plant, fruit or vegetable, or a seed. In still other embodiments, the porous material is paper. Advantages of paper include: cost (paper is inexpensive); it is fully commercialized and its physical and chemical properties can be adjusted; it can filter particulates (cells and dusts) from liquid samples; it is easily shaped (e.g., easy to cut, tear, or fold); liquids flow in it under capillary action (e.g., without external pumping and/or a power supply); and it is disposable.

In particular embodiments, the porous material is filter paper. Exemplary filter papers include cellulose filter paper, ashless filter paper, nitrocellulose paper, glass microfiber filter paper, and polyethylene paper. Filter paper having any pore size may be used. Exemplary pore sizes include Grade 1 (11 μm), Grade 2 (8 μm), Grade 595 (4-7 μm), and Grade 6 (3 μm), Pore size will not only influence the transport of liquid inside the spray materials, but could also affect the formation of the Taylor cone at the tip. The optimum pore size will generate a stable Taylor cone and reduce liquid evaporation. The pore size of the filter paper is also an important parameter in filtration, i.e., the paper acts as an online pretreatment device. Commercially available ultrafiltration membranes of regenerated cellulose, with pore sizes in the low nm range, are designed to retain particles as small as 1000 Da. Ultra filtration membranes can be commercially obtained with molecular weight cutoffs ranging from 1000 Da to 100,000 Da.

In other embodiments, the porous material is treated to produce microchannels in the porous material or to enhance the properties of the material for use in a probe of the invention. For example, paper may undergo a patterned silanization process to produce microchannels or structures on the paper. Such processes involve, for example, exposing the surface of the paper to tridecafluoro-1,1,2,2-tetrahydrooctyl-1-trichlorosilane to result in silanization of the paper. In other embodiments, a soft lithography process is used to produce microchannels in the porous material or to enhance the properties of the material for use as a probe of the invention. In other embodiments, hydrophobic trapping regions are created in the paper to pre-concentrate less hydrophilic compounds. Hydrophobic regions may be patterned onto paper by using photolithography, printing methods or plasma treatment to define hydrophilic channels with lateral features of 200-1000 μm. See Martinez et al. (Angew. Chem. Int. Ed. 2007, 46, 1318-1320); Martinez et al. (Proc. Natl Acad. Sci. USA 2008, 105, 19606-19611); Abe et al. (Anal. Chem. 2008, 80, 6928-6934); Bruzewicz et al. (Anal. Chem. 2008, 80, 3387-3392); Martinez et al. (Lab Chip 2008, 8, 2146-2150); and Li et al. (Anal. Chem. 2008, 80, 9131-9134), the content of each of which is incorporated by reference herein in its entirety. Liquid samples loaded onto such a paper-based device can travel along the hydrophilic channels driven by capillary action.

Another application of the modified surface is to separate or concentrate compounds according to their different affinities with the surface and with the solution. Some compounds are preferably absorbed on the surface while other chemicals in the matrix prefer to stay within the aqueous phase. Through washing, sample matrix can be removed while compounds of interest remain on the surface. The compounds of interest can be removed from the surface at a later point in time by other high-affinity solvents. Repeating the process helps desalt and also concentrate the original sample.

In certain embodiments, chemicals are applied to the porous material to modify the chemical properties of the porous material. For example, chemicals can be applied that allow differential retention of sample components with different chemical properties. Additionally, chemicals can be applied that minimize salt and matrix effects. In other embodiments, acidic or basic compounds are added to the porous material to adjust the pH of the sample upon spotting. Adjusting the pH may be particularly useful for improved analysis of biological fluids, such as blood. Additionally, chemicals can be applied that allow for on-line chemical derivatization of selected analytes, for example to convert a non-polar compound to a salt for efficient electrospray ionization.

In certain embodiments, the chemical applied to modify the porous material is an internal standard. The internal standard can be incorporated into the material and released at known rates during solvent flow in order to provide an internal standard for quantitative analysis. In other embodiments, the porous material is modified with a chemical that allows for pre-separation and pre-concentration of analytes of interest prior to mass spectrum analysis.

In certain embodiments, the porous material is kept discrete (i.e., separate or disconnected) from a flow of solvent, such as a continuous flow of solvent. Instead, sample is either spotted onto the porous material or swabbed onto it from a surface including the sample. A discrete amount of extraction solvent is introduced into the port of the probe housing to interact with the sample on the substrate and extract one or more analytes from the substrate. A voltage source is operably coupled to the probe housing to apply voltage to the solvent including the extract analytes to produce ions of the analytes that are subsequently mass analyzed. The sample is extracted from the porous material/substrate without the need of a separate solvent flow.

A solvent is applied to the porous material to assist in separation/extraction and ionization. Any solvents may be used that are compatible with mass spectrometry analysis. In particular embodiments, favorable solvents will be those that are also used for electrospray ionization. Exemplary solvents include combinations of water, methanol, acetonitrile, and tetrahydrofuran (THF). The organic content (proportion of methanol, acetonitrile, etc. to water), the pH, and volatile salt (e.g. ammonium acetate) may be varied depending on the sample to be analyzed. For example, basic molecules like the drug imatinib are extracted and ionized more efficiently at a lower pH. Molecules without an ionizable group but with a number of carbonyl groups, like sirolimus, ionize better with an ammonium salt in the solvent due to adduct formation.

Discontinuous Atmospheric Pressure Interface (DAPI)

In certain embodiments, a discontinuous atmospheric pressure interface (DAPI) is used with systems and methods of the invention. Discontinuous atmospheric interfaces are described in Ouyang et al. (U.S. Pat. No. 8,304,718 and PCT application number PCT/US2008/065245), the content of each of which is incorporated by reference herein in its entirety.

Figure 5:
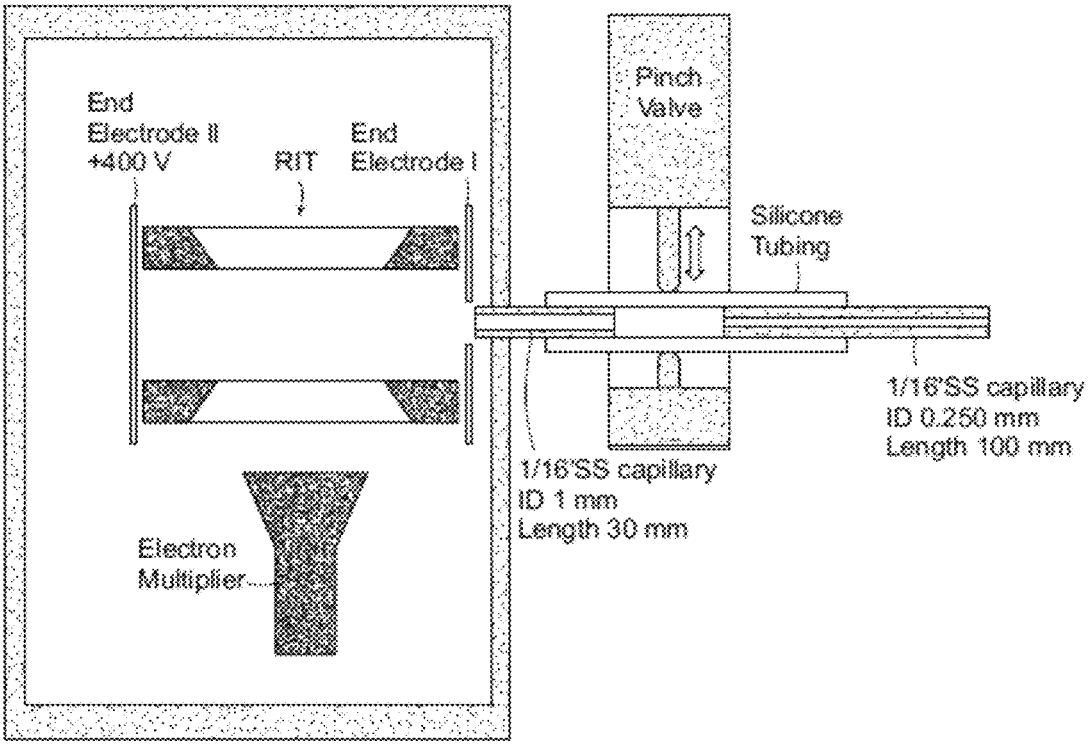
FIG. 5 is a schematic showing a discontinuous atmospheric pressure interface coupled in a miniature mass spectrometer with rectilinear ion trap.

An exemplary DAPI is shown in FIG. 5. The concept of the DAPI is to open its channel during ion introduction and then close it for subsequent mass analysis during each scan. An ion transfer channel with a much bigger flow conductance can be allowed for a DAPI than for a traditional continuous API. The pressure inside the manifold temporarily increases significantly when the channel is opened for maximum ion introduction. All high voltages can be shut off and only low voltage RF is on for trapping of the ions during this period. After the ion introduction, the channel is closed and the pressure can decrease over a period of time to reach the optimal pressure for further ion manipulation or mass analysis when the high voltages can be is turned on and the RF can be scanned to high voltage for mass analysis.

A DAPI opens and shuts down the airflow in a controlled fashion. The pressure inside the vacuum manifold increases when the API opens and decreases when it closes. The combination of a DAPI with a trapping device, which can be a mass analyzer or an intermediate stage storage device, allows maximum introduction of an ion package into a system with a given pumping capacity.

Much larger openings can be used for the pressure constraining components in the API in the new discontinuous introduction mode. During the short period when the API is opened, the ion trapping device is operated in the trapping mode with a low RF voltage to store the incoming ions; at the same time the high voltages on other components, such as conversion dynode or electron multiplier, are shut off to avoid damage to those device and electronics at the higher pressures. The API can then be closed to allow the pressure inside the manifold to drop back to the optimum value for mass analysis, at which time the ions are mass analyzed in the trap or transferred to another mass analyzer within the vacuum system for mass analysis. This two-pressure mode of operation enabled by operation of the API in a discontinuous fashion maximizes ion introduction as well as optimizing conditions for the mass analysis with a given pumping capacity.

The design goal is to have largest opening while keeping the optimum vacuum pressure for the mass analyzer, which is between $10^{-3}$ to $10^{-10}$ torr depending the type of mass analyzer. The larger the opening in an atmospheric pressure interface, the higher is the ion current delivered into the vacuum system and hence to the mass analyzer.

An exemplary embodiment of a DAPI is described herein. The DAPI includes a pinch valve that is used to open and shut off a pathway in a silicone tube connecting regions at atmospheric pressure and in vacuum. A normally-closed pinch valve (390NC24330, ASCO Valve Inc., Florham Park, N.J.) is used to control the opening of the vacuum manifold to atmospheric pressure region. Two stainless steel capillaries are connected to the piece of silicone plastic tubing, the open/closed status of which is controlled by the pinch valve. The stainless steel capillary connecting to the atmosphere is the flow restricting element, and has an ID of 250 μm, an OD of 1.6 mm (1/16") and a length of 10 cm. The stainless steel capillary on the vacuum side has an ID of 1.0 mm, an OD of 1.6 mm (1/16") and a length of 5.0 cm. The plastic tubing has an ID of 1/16", an OD of 1/8" and a length of 5.0 cm. Both stainless steel capillaries are grounded. The pumping system of the mini 10 consists of a two-stage diaphragm pump 1091-N84.0-8.99 (KNF Neuberger Inc., Trenton, N.J.) with pumping speed of 5 L/min (0.3 m3/hr) and a TPD011 hybrid turbomolecular pump (Pfeiffer Vacuum Inc., Nashua, N.H.) with a pumping speed of 11 L/s.

When the pinch valve is constantly energized and the plastic tubing is constantly open, the flow conductance is so high that the pressure in vacuum manifold is above 30 torr with the diaphragm pump operating. The ion transfer efficiency was measured to be 0.2%, which is comparable to a lab-scale mass spectrometer with a continuous API. However, under these conditions the TPD 011 turbomolecular pump cannot be turned on. When the pinch valve is de-energized, the plastic tubing is squeezed closed and the turbo pump can then be turned on to pump the manifold to its ultimate pressure in the range of $1\times10^{5}$ torr.

The sequence of operations for performing mass analysis using ion traps usually includes, but is not limited to, ion introduction, ion cooling and RF scanning. After the manifold pressure is pumped down initially, a scan function is implemented to switch between open and closed modes for ion introduction and mass analysis. During the ionization time, a 24 V DC is used to energize the pinch valve and the API is open. The potential on the rectilinear ion trap (RIT) end electrode is also set to ground during this period. A minimum response time for the pinch valve is found to be 10 ms and an ionization time between 15 ms and 30 ms is used for the characterization of the discontinuous API. A cooling time between 250 ms to 500 ms is implemented after the API is closed to allow the pressure to decrease and the ions to cool down via collisions with background air molecules. The high voltage on the electron multiplier is then turned on and the RF voltage is scanned for mass analysis. During the operation of the discontinuous API, the pressure change in the manifold can be monitored using the micro pirani vacuum gauge (MKS 925C, MKS Instruments, Inc. Wilmington, Mass.) on Mini 10.

INCORPORATION BY REFERENCE

References and citations to other documents, such as patents, patent applications, patent publications, journals, books, papers, web contents, have been made throughout this disclosure. All such documents are hereby incorporated herein by reference in their entirety for all purposes.

EQUIVALENTS

Various modifications of the invention and many further embodiments thereof, in addition to those shown and described herein, will become apparent to those skilled in the art from the full contents of this document, including references to the scientific and patent literature cited herein. The subject matter herein contains important information, exemplification and guidance that can be adapted to the practice of this invention in its various embodiments and equivalents thereof.

EXAMPLES

Example 1: Materials

Chromatography paper (grade 1) used for sample loading strip was purchased from Whatman (Whatman International Ltd., Maidstone, ENG). Borosilicate glass tube (0.86 mm, id) modified for nanoESI tip was purchased from Sutter Instrument (Sutter Instrument Co, Novato, Calif., US). All the organic solvent without specified were supplied by Macron Chemicals (Avantor Performance Materials Inc., Phillipsburg, N.J., US). Bovine whole blood (with $EDTAK_2$ as anticoagulant) was purchased from Innovative Research (Novi, Mich., US). All other reagents were purchased from Sigma-Aldrich (Milwaukee, Wis., US).

Example 2: Sample Preparation

All analytes were dissolved into methanol: $H_2O$ 50:50 (v:v) for stock solutions. Orange homogenate was prepared by homogenizing 10 g of orange in 10 mL of water. Porcine homogenate was prepared with 2 g of pork in 15 mL of water. For imitating raw samples, analytes from stock solutions were directly diluted to low concentrations using matrices as solvents.

Example 3: Extraction Spray

Samples used in the study were first loaded by direct pipetting 0.2 μL sample solutions onto the sample substrate, a paper strip (1 cm length, 0.5 mm width, 0.18 mm thickness, grade 1), and dried in air for 1 hr before loading. An extraction spray source was assembled by inserting the sample substrate to a glass nanoESI tube (0.86 mmID). Organic solvent of 10 μL, such as MeOH and acetonitrile, was filled into the tube for analyte extraction and subsequent spray facilitated with a DC voltage about 2 kV applied through a wire electrode (FIG. 1A).

Example 4: Mass Spectrometric Analysis

Extraction solvent and signal stability assessment were performed using a TSQ Quantum Access Max (Thermo Scientific, San Jose, Calif.) with a heated capillary API in the product ion mode and the single reaction monitoring (SRM) mode. The instrument settings were as followed: methamphetamine: m/z 150; collision energy: 20; scan time: 0.500 and sunitinib m/z 399→283; tube lens: 130 V; Q2 offset: 18 V.

Other assessments were completed using an AB Sciex QTRAP4000 (Sciex, Foster City, Calif.) with a curtain gas API. Typical instrumental parameters were set as follows: spray voltage 2 kV, curtain gas, 10 psi; de-clustering potential (DP), 20 V; scan rate, 1000 Da/s.

Example 5: Mass Spectrometric Analysis with Miniature Mass Spectrometer

Figure 4:
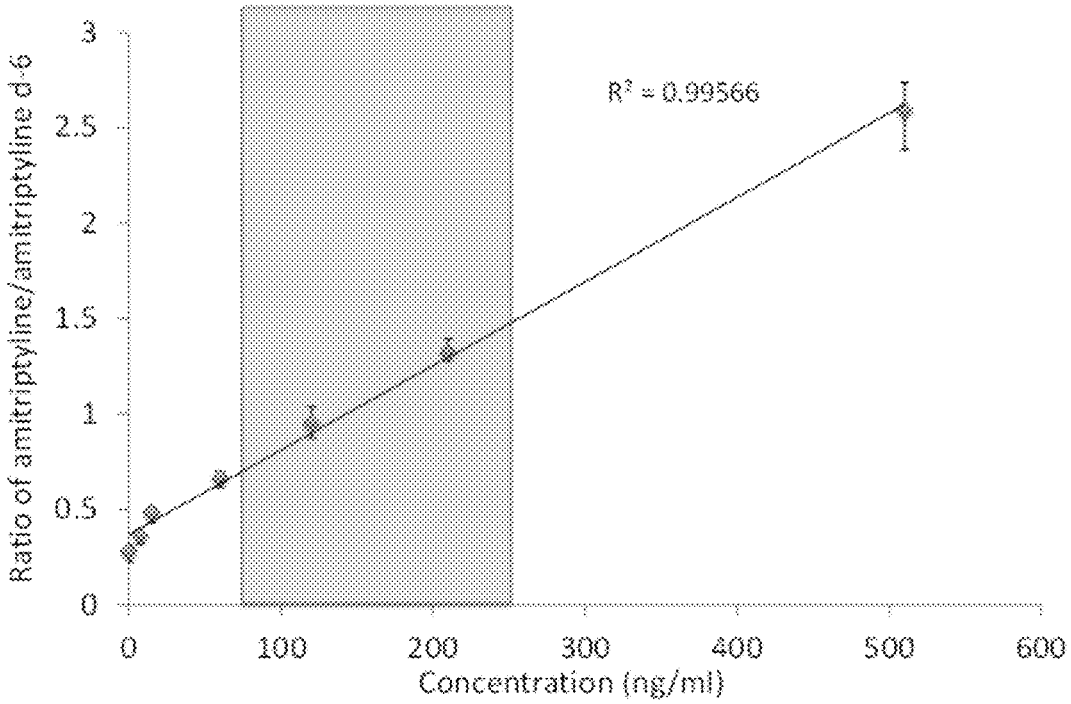
FIG. 4 is a graph showing quantitation of therapeutic drugs in blood sample using Mini 12 mass spectrometer with extraction spray. Calibration curve for amitriptyline in bovine blood with amitriptyline-d6 (100 ng/ml) as internal standard. SRM m/z 278 to 233 and m/z 284 to 233 was used for analyte and internal standard, respectively. Sample Whatman Grad 1 chromatography paper, 0.18 mm thickness, 8 mm long, 0.8 mm wide. Dried blood spot prepared with 2 μL blood sample. 7 μL methanol used for extraction spray. 1800 V applied for spray.

Limit of detection (LOD) and limit of quantitation achieved with Mini 12 (L. Li, Y. Ren, T.-C. Chen, Z. Lin, R. G. Cooks and Z. Ouyang "Development and Performance Characterization of a Personal Mass Spectrometry System", 61st ASMS Conference on Mass Spectrometry and Allied Topics, Minneapolis, Minn., Jun. 9-13, 2013, MP 330) and extraction spray (FIG. 4).

LOD:

Better than 10 ng/ml for Verapamil in blood with extraction spray

LOQ:

7.5 ng/ml Amitriptyline in blood with extraction spray (with IS)

What is claimed is:

1. A system for analyzing a sample, the system comprising:

an ionization probe, the probe comprising:

a hollow body that comprises a distal tip;

a paper substrate configured to hold a sample, the paper substrate being at least partially disposed within the hollow body and positioned prior to the distal tip such that an analyte in the sample extracted from the paper substrate by a solvent flows into the hollow body prior to exiting the distal tip, wherein the hollow body is devoid of separation material after the paper substrate; and an electrode disposed prior to the distal tip of the hollow body that operably interacts with the extracted analyte in the solvent to expel the sample from the distal tip and produce ions of the analyte; and a mass analyzer operably coupled to the probe to receive the ions of the probe.

2. The system according to claim 1, wherein the hollow body is composed of glass.

3. The system according to claim 1, wherein the paper substrate is filter paper.

4. The system according to claim 1, wherein the mass analyzer is for a mass spectrometer or a miniature mass spectrometer.

5. The system according to claim 4, wherein the mass analyzer is selected from the group consisting of: a quadrupole ion trap, a rectalinear ion trap, a cylindrical ion trap, a ion cyclotron resonance trap, and an orbitrap.

6. The system according to claim 1, further comprising a source of nebulizing gas.

7. The system according to claim 6, wherein the source of nebulizing gas is configured to provide pulses of gas.

8. The system according to claim 6, wherein the source of nebulizing gas is configured to provide a continuous flow of gas.

9. A method for analyzing a sample, the method comprising:

introducing a solvent to a sample held by a paper substrate that is at least partially disposed within a hollow body comprising a distal tip, wherein the solvents interacts with the sample held by the paper substrate to extract an analyte from the sample into the solvent, wherein the hollow body is devoid of separation material after the paper substrate;

applying a voltage to the extracted analyte in the solvent in the hollow body from an electrode disposed prior to the distal tip of the hollow body to expel the sample from the distal tip of the body, thereby generating ions of the analyte; and analyzing the ions.

10. The method according to claim 9, wherein a nebulizing gas is also applied to the extracted sample.

11. The method according to claim 10, wherein the nebulizing gas is pulsed.

12. The method according to claim 10, wherein the nebulizing gas is provided as a continuous flow of gas.

13. The method according to claim 9, wherein the paper substrate is filter paper.

14. The method according to claim 9, wherein the mass analyzer is for a mass spectrometer or a miniature mass spectrometer.

15. The method according to claim 9, wherein the sample is introduced to the paper substrate prior to the paper substrate being inserted into the hollow body.

16. The method according to claim 9, wherein the sample is introduced to the paper substrate after the paper substrate has been inserted into the hollow body.

* * * * *